US009622578B2

(12) United States Patent
Goetz et al.

(10) Patent No.: US 9,622,578 B2
(45) Date of Patent: Apr. 18, 2017

(54) DRIVE DEVICE FOR A MOVABLE FURNITURE PART

(71) Applicant: Julius Blum GmbH, Hoechst (AT)

(72) Inventors: Christof Goetz, Lustenau (AT); Ingo Gasser, Hoechst (AT); Hermann Haemmerle, Lustenau (AT)

(73) Assignee: JULIUS BLUM GMBH, Hoechst (AT)

( * ) Notice: Subject to any disclaimer, the term of this patent is extended or adjusted under 35 U.S.C. 154(b) by 0 days.

(21) Appl. No.: 14/844,460

(22) Filed: Sep. 3, 2015

(65) Prior Publication Data

US 2015/0374123 A1 Dec. 31, 2015

Related U.S. Application Data

(63) Continuation of application No. PCT/AT2014/000055, filed on Mar. 26, 2014.

(30) Foreign Application Priority Data

Apr. 12, 2013 (AT) ..... A 296/2013

(51) Int. Cl.
*A47B 95/02* (2006.01)
*A47B 88/04* (2006.01)
(Continued)

(52) U.S. Cl.
CPC ..... *A47B 88/0477* (2013.01); *A47B 88/047* (2013.01); *A47B 88/16* (2013.01);
(Continued)

(58) Field of Classification Search
CPC ..... A47B 88/047; A47B 88/0477; A47B 88/0481; A47B 2088/0474
See application file for complete search history.

(56) References Cited

U.S. PATENT DOCUMENTS 8,056,992 B2 11/2011 Gassner
8,622,493 B2 1/2014 Roeck
(Continued)

FOREIGN PATENT DOCUMENTS

AT 511444 B1 * 12/2012 ..... A47B 88/0477
CN 101668457 3/2010
(Continued)

OTHER PUBLICATIONS

International Search Report issued Jul. 1, 2014 in corresponding International Application No. PCT/AT2014/000055 (with English translation).
(Continued)

*Primary Examiner* — Daniel J Troy
*Assistant Examiner* — Andres F Gallego
(74) *Attorney, Agent, or Firm* — Wenderoth, Lind & Ponack, L.L.P.

(57) ABSTRACT

A drive device for a movable furniture part includes an ejection device which can be locked in a locked position, the ejection device being used to move the movable furniture part from a closed position into an open position. The ejection device can be unlocked by pushing the movable furniture part so that the movable furniture part moves into a pushed-in position which is beyond the closed position in a closing direction, this enables the ejection device to move the movable furniture part in an opening direction; and the movable furniture part can also be moved from the closed position into the open position by pulling the movable furniture part, the ejection device remaining in the locked position when opened by pulling. The drive device also includes a coupling device for coupling the drive device to the movable furniture part or to a furniture body.

20 Claims, 10 Drawing Sheets

(51) Int. Cl.

| | |
|---|---|
| ***A47B 88/16*** | (2006.01) |
| ***E05B 65/462*** | (2017.01) |
| ***A47B 88/467*** | (2017.01) |
| ***A47B 88/463*** | (2017.01) |
| ***A47B 88/47*** | (2017.01) |
| ***A47B 88/57*** | (2017.01) |

(52) U.S. Cl.

CPC ..... *A47B 88/463* (2017.01); *A47B 88/467* (2017.01); *A47B 88/47* (2017.01); *A47B 88/57* (2017.01); *E05B 65/462* (2013.01)

(56) References Cited

U.S. PATENT DOCUMENTS

| | | | | |
|---|---|---|---|---|
| 9,386,850 | B2 | 7/2016 | Dubach | |
| 2008/0191592 | A1* | 8/2008 | Dubach | A47B 88/0477 312/319.1 |
| 2010/0041484 | A1 | 2/2010 | Gassner | |
| 2010/0314981 | A1 | 12/2010 | Koenig et al. | |
| 2012/0001441 | A1 | 1/2012 | Juan et al. | |
| 2012/0294555 | A1 | 11/2012 | Roeck | |
| 2013/0140970 | A1* | 6/2013 | Dubach | A47B 88/0477 312/319.1 |
| 2014/0021841 | A1 | 1/2014 | Brunnmayr | |
| 2014/0210329 | A1* | 7/2014 | Brunnmayr | A47B 88/0477 312/333 |

FOREIGN PATENT DOCUMENTS

| | | | | |
|---|---|---|---|---|
| CN | 102762127 | | 10/2012 | |
| CN | 102917617 | | 2/2013 | |
| DE | 10 2010 036 903 | | 9/2011 | |
| DE | 20 2011 000 362 | | 9/2011 | |
| DE | WO 2012084595 | A1 * | 6/2012 | A47B 88/0477 |
| DE | 10 2011 002 212 | | 10/2012 | |
| EP | 2 294 944 | | 3/2011 | |
| EP | 2 374 369 | | 10/2011 | |
| JP | 2011-5243 | | 1/2011 | |
| JP | 2013-500806 | | 1/2013 | |
| WO | 2009/114886 | | 9/2009 | |
| WO | 2011/015663 | | 2/2011 | |
| WO | 2011/143682 | | 11/2011 | |
| WO | 2012/010590 | | 1/2012 | |
| WO | 2012/149587 | | 11/2012 | |

OTHER PUBLICATIONS

Austrian Search Report issued Jan. 14, 2014 in corresponding Austrian Patent Application No. 296/2013 (with English translation).

Search Report issued Sep. 8, 2016 in corresponding Chinese Patent Application No. 201480020571.X (English Translation).

* cited by examiner

SS+V+K

OS+K

SS+V+K

OS+V+K

OS + V

DRIVE DEVICE FOR A MOVABLE FURNITURE PART

BACKGROUND OF THE INVENTION

1. Field of the Invention

The invention concerns a drive device for a furniture part movable in a furniture carcass, comprising an ejection device lockable in a locked position for moving the movable furniture part from a closed position into an open position, wherein the ejection device is unlockable by over-pressing the movable furniture part into an over-pressing position which is behind the closed position in a closing direction, whereby the movable furniture part is movable by the ejection device in an opening direction, wherein the movable furniture part is also movable from the closed position into the open position by pulling on the movable furniture part, wherein the ejection device remains in the locked position upon opening by pulling, and a coupling device for coupling the drive device to the movable furniture part or to the furniture carcass. The invention further concerns an article of furniture having such a drive device.

2. Description of Related Art

So-called touch latch mechanisms have already been known for many years in the furniture fitting industry, in which an ejection device is unlocked by pressing against the movable furniture part which is in the closed position, whereupon the movable furniture part (for example, a drawer or a furniture flap) is ejected in the opening direction.

In simple touch latch mechanisms of a different general kind, the ejection device is disposed anywhere on the furniture carcass and ejects the movable furniture part at least during the first opening travel. There is no coupling device for coupling the drive device to the movable furniture part. Rather, there is only an abutment surface against which the movable furniture part directly or indirectly bears. If, in the case of such a drive device, instead of over-pressing the movable furniture part, the movable furniture part is simply pulled starting from the closed position, then the movable furniture part is lifted away from the abutment surface without triggering a movement in the drive device.

Conversely, in WO 2012/149587 A1, which is also of a different general kind, a coupling device remains in a coupling position upon ejection of the movable furniture part whereas, however, the locking device with the cardioid-shaped guide path is no longer in the locking position when opening the movable furniture part by pulling. Rather, there is provided an evasion passage by which the locking pin can evasively pass through the "heart" of the cardioid when opening by pulling. The locking position is therefore preserved upon opening by pulling.

In WO 2011/015663 A1, which relates to a different general kind of device, the coupling position between the drive device and the movable furniture part or furniture carcass is also maintained in the same fashion upon opening by pulling, but unlocking of the lockable ejection device is implemented both upon unlocking by over-pressing and also upon unlocking by pulling.

In comparison, WO 2009/114886 A1, disclosing a device of the general kind set forth herein, discloses a kind of overload protection device in which the ejection device remains in a locking position upon opening by pulling (see FIG. 30*c*). The catch fork, however, is pivoted against the force of a spring by a pin associated with the furniture carcass whereby the drive device is no longer coupled to the furniture carcass upon opening by pulling. A disadvantage with that structure is that, upon such opening by pulling, the drive device has to be unlocked upon reclosing the furniture part so that it is only after that that the pin can be coupled to the catch element again.

SUMMARY OF THE INVENTION

Therefore, the object of the present invention is to provide a drive device which is an alternative or which is improved over the state of the art. In particular, the invention seeks to avoid the disadvantages of the state of the art defining the general kind of drive device involved here.

That is achieved by a drive device having features described herein. In accordance therewith, it is provided that the coupling device is in a coupling position upon ejection of the movable furniture part by the ejection device, wherein the coupling device is movable loosely with respect to the ejection device upon opening by pulling. Accordingly, the coupling device remains in a coupling position at least portion-wise upon opening by pulling and the coupling device can be movable free of a spring loading of an overload spring. In addition, no unlocking has to be effected upon reclosing as, when the furniture part is pushed in, the components of the coupling device can be simply coupled together again.

The "loose" movement of the coupling device with respect to the ejection device can be defined in other words by stating that, upon opening by pulling, the coupling device is movable independently of the ejection device. To put it another away, the coupling device is not connected to the ejection device upon opening by pulling. In that case, the coupling device can be movable with a translatory component with respect to the drive device, wherein, for example, the coupling device is movable without a spring loading in a linear portion of a guide path.

Basically it can be provided that the coupling device is in a coupling position during the entire opening travel of the movable furniture part. It is, however, preferably provided that, upon opening by pulling, the coupling device remains in the coupling position only in a first opening travel portion which is in front of the closed position in the opening direction. In that case, the first opening travel portion can be between 10 mm and 100 mm, preferably between 20 mm and 70 mm, in length.

It is particularly preferably provided for the loose movement that the coupling device has a transmission abutment, by way of which the coupling device bears against a triggering abutment of the ejection device in the closed position and in an over-pressing region between the closed position and the over-pressing position, whereas upon opening by pulling the transmission abutment lifts away from the triggering abutment or moves away therefrom so that there is no longer any contact between the transmission abutment and the triggering abutment.

In an embodiment of the invention, it can be provided that the drive device has a base plate. It is particularly preferably provided in that respect that the ejection device has a preferably cardioid-shaped guide path in the base plate, an ejection slider which is movable preferably linearly along the base plate, a locking lever mounted pivotably to the ejection slider, a locking pin mounted to the locking lever and displaceable in the guide path and an ejection force storage means fixed on the one hand to the base plate and on the other hand to the ejection slider. With such a structure, basically, the triggering abutment can be provided on any component, for example, on the ejection slider of the ejection device. It is preferably provided, however, that the triggering abutment of the ejection device is on the locking lever.

In addition, in a preferred embodiment of the invention, it can be provided that the coupling device has a coupling slider displaceable at least portion-wise linearly in the base plate and a catch element mounted movably, preferably pivotably, on the coupling slider, for a coupling entrainment portion arranged on the furniture carcass or on the movable furniture part, wherein the coupling slider and the catch element are displaceable along a portion-wise linear guide path in the base plate, having an angled end portion. It is preferably provided in that case that the transmission abutment of the coupling device is provided on the coupling slider.

In order to integrate not just the function of active ejection by over-pressing into the drive device, the drive device can preferably also have a retraction device for retraction of the movable furniture part from an open position into the closed position. For coupling the retraction device to the furniture carcass or to the movable furniture part, it can be provided in that case that the retraction device can be brought into engagement by way of a retraction catch element with a retraction entrainment portion which is separate from the coupling entrainment portion.

If the ejection device and the retraction device of the drive device form a common structural unit, it is preferably provided that the retraction device can be at least portion-wise coupled to the coupling device by way of the retraction catch element and upon opening by pulling a retraction force storage means of the retraction device can be stressed along the first opening travel portion. Thus, the coupling device is in the coupling position, upon retraction by the retraction device.

Basically, however, the retraction device and the ejection device do not have to be in the form of a structural unit. Rather, it can also often happen that a drive device according to the invention is to be retrofitted in already existing movable furniture parts or in extension guide assemblies. In that case, for example, retraction devices which each have a retraction entrainment portion are already provided in the extension guide assemblies. Accordingly, in that case, only the ejection device has to be retrofitted, in which case then two separate entrainment portions (retraction entrainment portion and coupling entrainment portion) are provided for making the connection or coupling between the drive device and the furniture carcass or the movable furniture part.

An article of furniture may have a furniture carcass, a furniture part movable relative to the furniture carcass and a drive device according to the invention for the movable furniture part. In that respect it can, in principle, be provided that the drive device is disposed on the furniture carcass and a coupling entrainment portion is associated with the movable furniture part. In a preferred embodiment, however, it is provided that the drive device is disposed on the movable furniture part, wherein the coupling device has a coupling entrainment portion which is associated with the furniture carcass and which can be brought into engagement with the catch element.

BRIEF DESCRIPTION OF THE DRAWINGS

Further details and advantages of the present invention are described more fully hereinafter by means of the specific description with reference to the embodiments by way of example illustrated in the drawings in which.

DETAILED DESCRIPTION OF THE INVENTION

Figure 1:
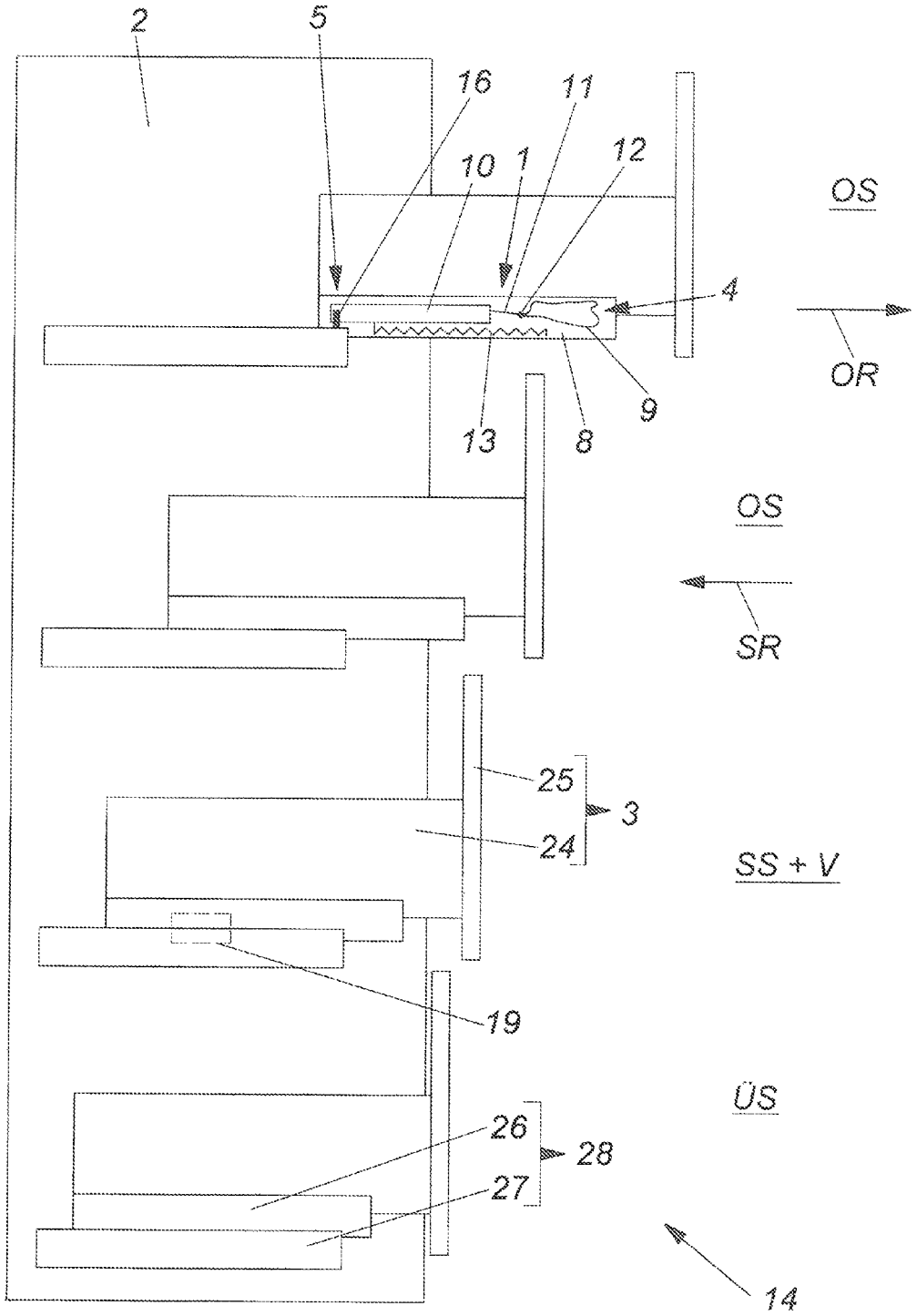
FIG. 1 diagrammatically shows an article of furniture with movable furniture parts in various positions.

FIG. 1 shows an article of furniture 14 comprising a furniture carcass 2 and a plurality of movable furniture parts 3 in the form of drawers. Viewed from above downwardly, the drawers are in an open position OS, then in an open position OS which is further moved in the closing direction SR, then in the closed position SS and right at the bottom in the over-pressing position ÜS. In general, it is to be stated that the movable furniture part 3 comprises a drawer container 24 and a front panel 25. Each movable furniture part 3 is supported movably on the furniture carcass 2 by way of an extension guide assembly 28. In that respect, the extension guide assembly 28 has a drawer rail 26, a carcass rail 27, and optionally, a central rail (not shown). In addition, a diagrammatically indicated retraction device 19 can be provided, for example, between the drawer rail 26 and the carcass rail 27. The drive device 1 has an ejection device 4 which, in this case, is associated with the movable furniture part 3. As essential components, the ejection device 4 has the base plate 8 fixed to the movable furniture part 3 or to the drawer rail 26, the cardioid-shaped guide path 9 in the base plate 8, the ejection slider 10 mounted movably on the base plate 8, the locking lever 11 mounted pivotably to the ejection slider 10, the locking pin 12 which is mounted to the locking lever 11 and which is displaceable in the cardioid-shaped guide path 9 and the ejection force storage means 13 which is braced between the ejection slider 10 and the base plate 8. In addition, the ejection device 4 is coupled to the furniture carcass 2 by way of a coupling device 5 and the coupling entrainment portion 16.

Figure 2:
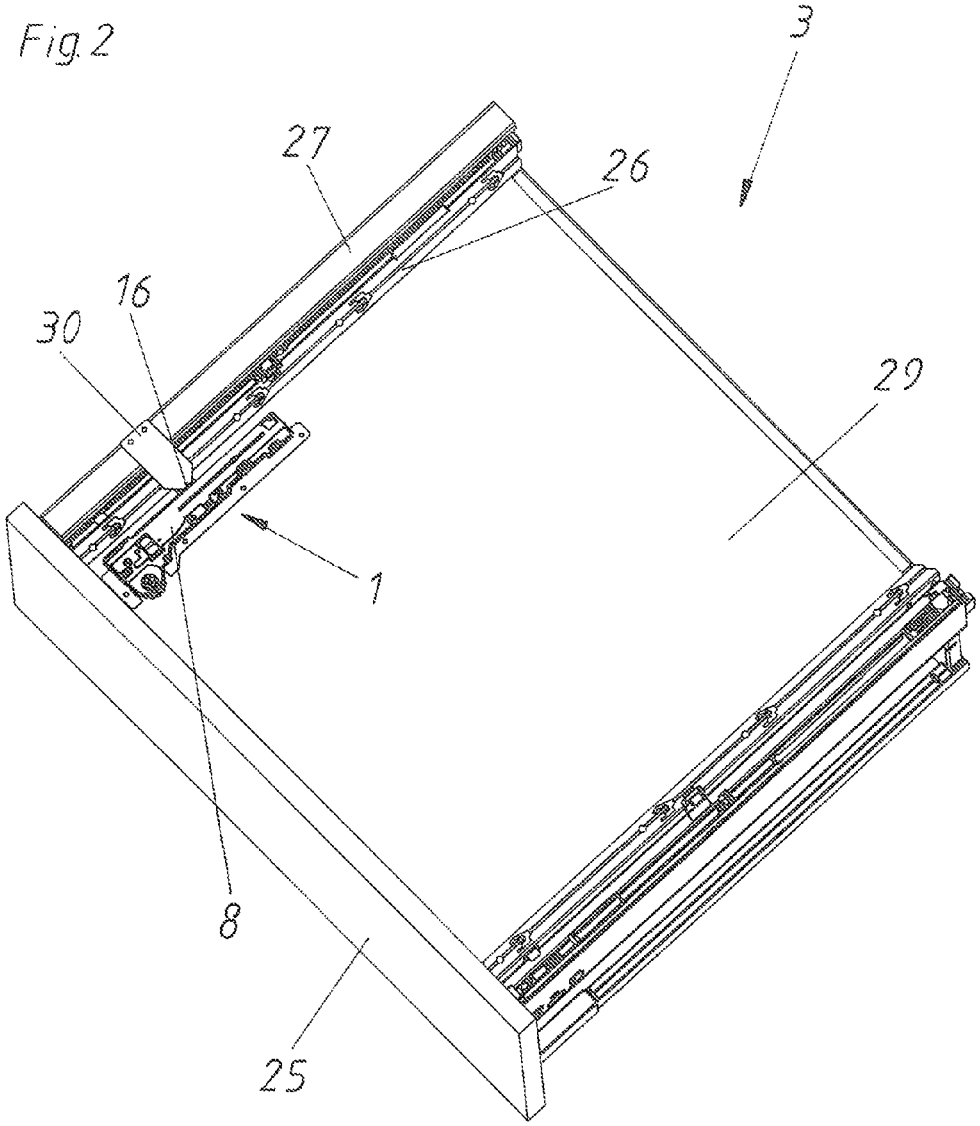
FIG. 2 shows a movable furniture part from below with a drive device.

The coupling entrainment portion 16 is also visible in FIG. 2, being mounted to the carcass rail 27 by way of the entrainment plate 30. The drive device 1 itself is mounted to the drawer bottom 29 of the movable furniture part 3 by way of the base plate 8 or a cover 31.

Figure 3:
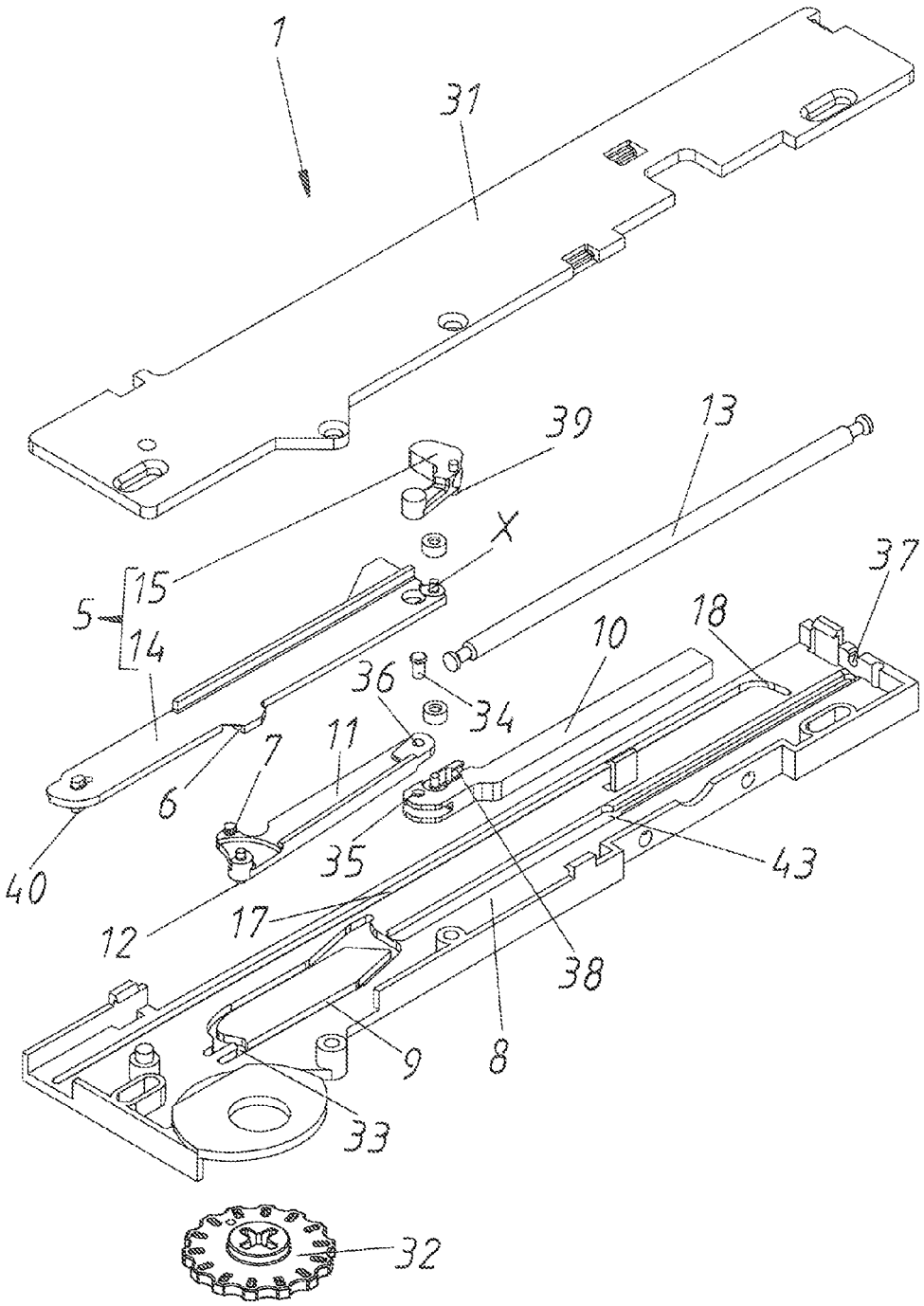
FIG. 3 shows an exploded view of a drive device.

It will be seen from the exploded view in FIG. 3 that the cardioid-shaped guide path 9 is provided in the base plate 8. In that case, the guide path 9 as an important component has the latching region 33. A depth adjusting wheel 32 is also rotatably mounted on the base plate 8. The ejection slider 10 of the ejection device 4 is mounted linearly displaceably along the guide path 43 on the base plate 8. The ejection force storage means 13, which is in the form of a tension spring, is braced between the ejection slider 10 and the base plate 8 by way of the spring base 37 and the spring base 38.

The locking lever 11 is mounted pivotably to the ejection slider 10 by way of the rotary mounting 35, the rotary pin 34 and the rotary mounting 36.

Arranged on the locking lever 11 is the locking pin 12 which is displaceable in the guide path 9 in the base plate 8. The triggering abutment 7 is also provided on the locking lever 11. In matching relationship therewith, the transmission abutment 6 is provided on the coupling slider 14. The catch element 15 is mounted pivotably to the coupling slider 14 by way of the axis of rotation X. The coupling slider 14 and the catch element 15 are mounted displaceably by way of the guide pins 39 and 40 in the guide path 17 in the base plate 8. The guide path 17 has an angled end portion 18 for the guide pin 39. The coupling slider 14 and the catch element 15, jointly with a coupling entrainment portion 16 which is not shown in FIG. 3, form the coupling device 5. The drive device 1 is closed with a cover 31 which can be fixed to the base plate 8.

Figure 4:
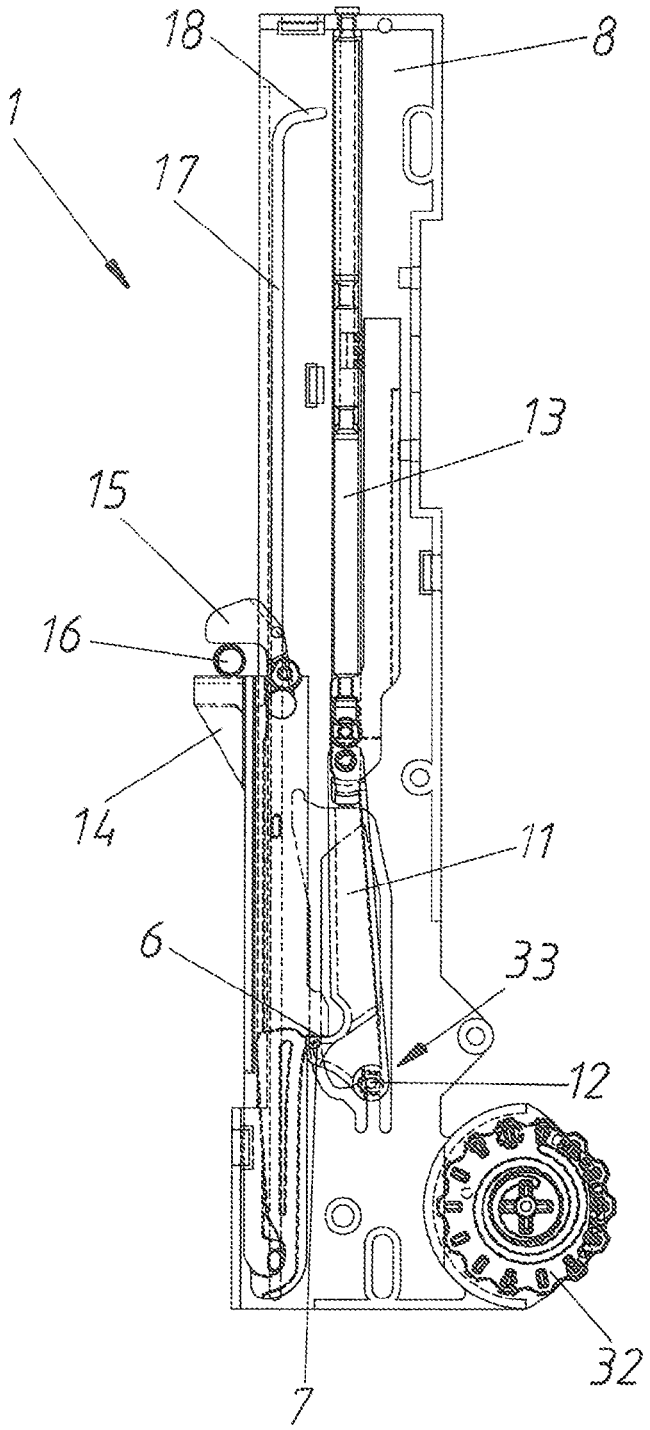
FIG. 4 shows the drive device in the closed position.

FIG. 4 shows the drive device 1 in a position when the movable furniture part is in the closed position SS. At the same time in the closed position SS, the lockable ejection device 4 is disposed in a locked position V as the locking pin 12 mounted to the locking lever 11 is in the latching region 33 of the guide path 9. The ejection force storage means 13 is stressed in the locked position V. In addition, the coupling device 5 is in a coupling position K in which the coupling entrainment portion 16 associated with the furniture carcass 2 is held or caught between the coupling slider 14 and the catch element 15. In the closed position SS, there is contact between the transmission abutment 6 on the coupling slider 4 and the triggering abutment 7 on the locking lever 11.

Figure 5:
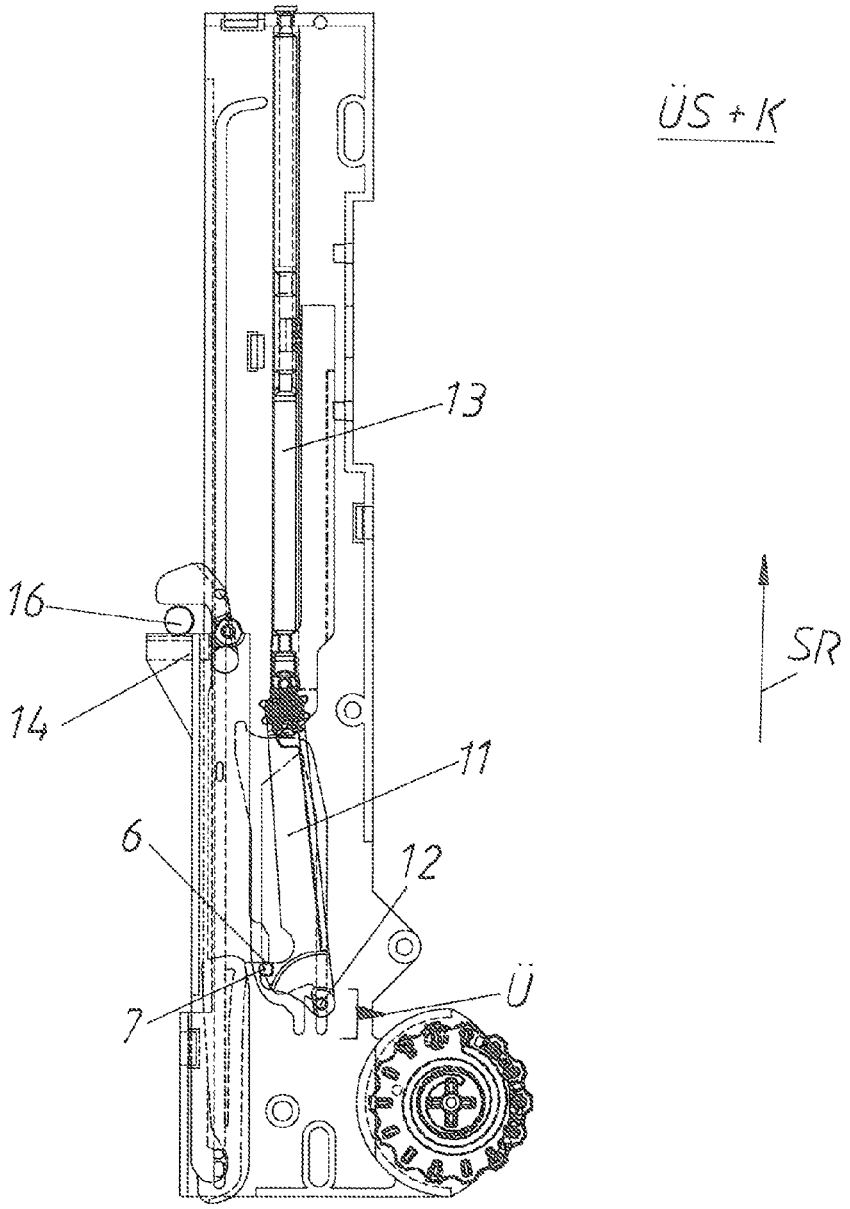
FIG. 5 shows the drive device in the over-pressing position.

If now, starting from that position shown in FIG. 4, a pressing force is applied to the movable furniture part 3 in the closing direction SR, then the movable furniture part 3 moves into an over-pressing region Ü between the closed position SS and the over-pressing position ÜS, as shown in FIG. 5. As the coupling entrainment portion 16 is fixed with respect to the carcass, when the furniture part 3 is over-pressed, the base plate 8 of the drive device 1 is moved in the closing direction SR relative to the coupling entrainment portion 16. As, however, the coupling entrainment portion 16 is coupled to the coupling device 5, the coupling slider 14 and by way of the transmission abutment 6 and the triggering abutment 7 also the locking lever 11 are moved relative to the base plate 8 whereby the locking pin 12 on the locking lever 11 is moved out of the latching region 33 of the cardioid-shaped guide path 9.

Figure 6:
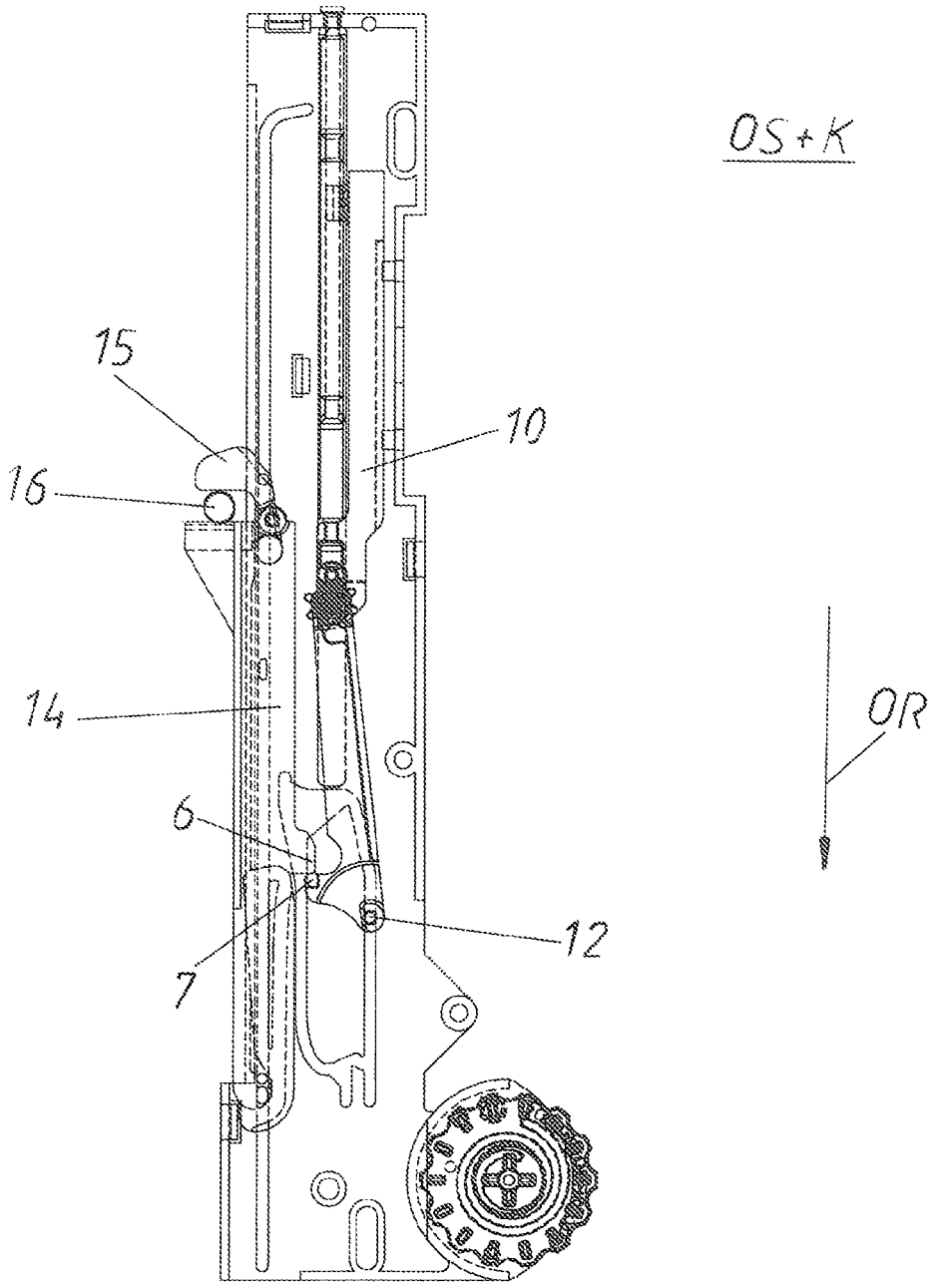
FIG. 6 shows the drive device upon ejection.

As soon as that position is reached, the ejection force storage means 13 is no longer locked and the ejection slider can move relative to the base plate 8 into the position of FIG. 6. With that movement of the ejection slider 10, the locking lever 11 and by way of the triggering abutment 7 and the transmission abutment 6 also the coupling slider 14 are also moved. As a result, the drive device 1 bears by way of the coupling device 5 against the coupling entrainment portion 16 and is in an open position OS in which the coupling device 5 is always still in the coupling position K.

Figure 7:
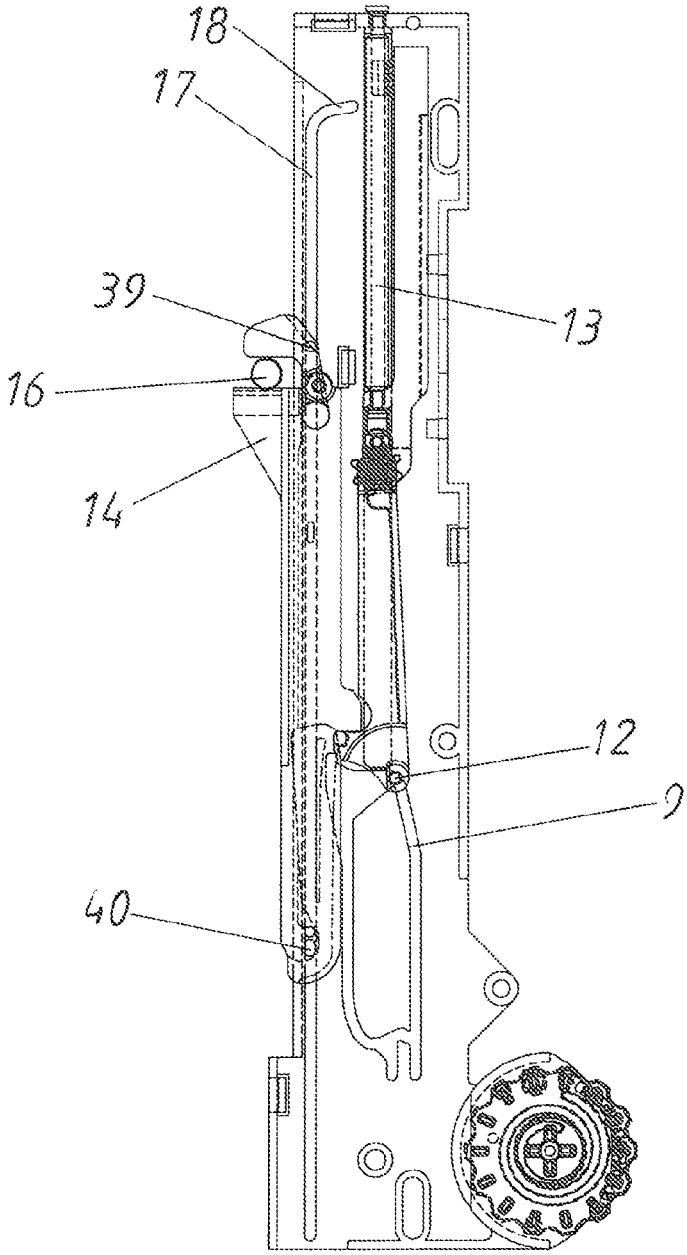
FIG. 7 shows the drive device after termination of the ejection process, FIGS. 8(*a*) and 8(*b*) show the drive device with ejection device and retraction device in the closed position, FIGS. 9(*a*) and 9(*b*) show the drive device upon opening by pulling, and FIGS. 10(*a*) and 10(*b*) show the drive device after termination of opening by pulling.

At the end of the ejection movement, the drive device 1 is in the position shown in FIG. 7 in which the movable furniture part 3 is still in an open position OS and the coupling device 5 also still remains in the coupling position K. To provide for uncoupling of the coupling device 5, the movable furniture part 3 is further moved in the opening direction OR either by momentum or by pulling until the catch element 15 passes by way of the guide pin 39 into the angled end portion 19 of the guide path 17 so that the coupling entrainment portion 16 is no longer caught between the coupling slider 14 and the catch element 15. The ejection force storage means 13 is relieved of stress in the position shown in FIG. 7.

Such a drive device 1 as shown in FIGS. 1 through 7 can be easily retrofitted in an existing movable furniture part 3. In that case, a retraction device 19 can already be disposed, for example, in the region of the extension guide assembly 28.

Figures 8A, 8B:
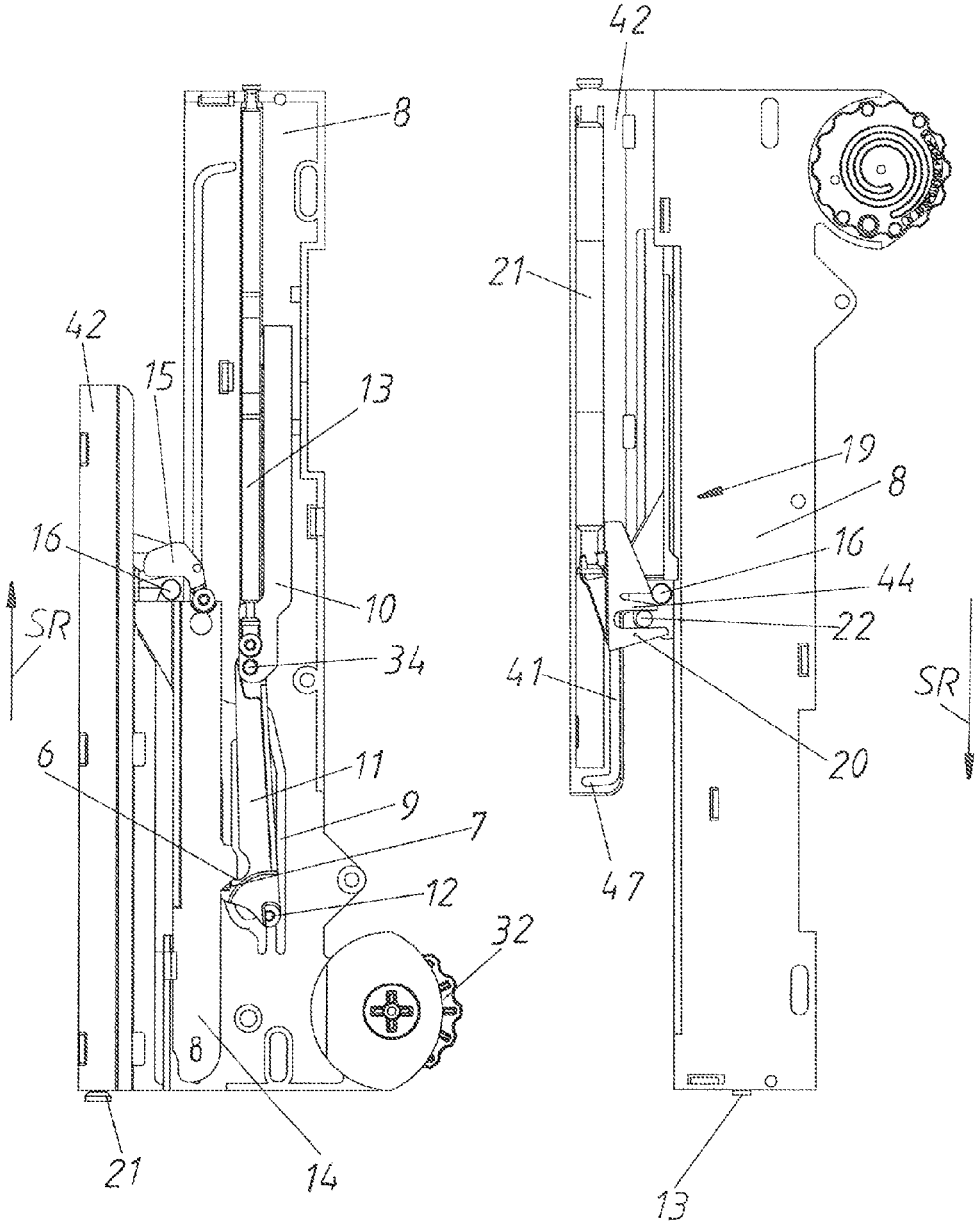
Figures 9A, 9B:
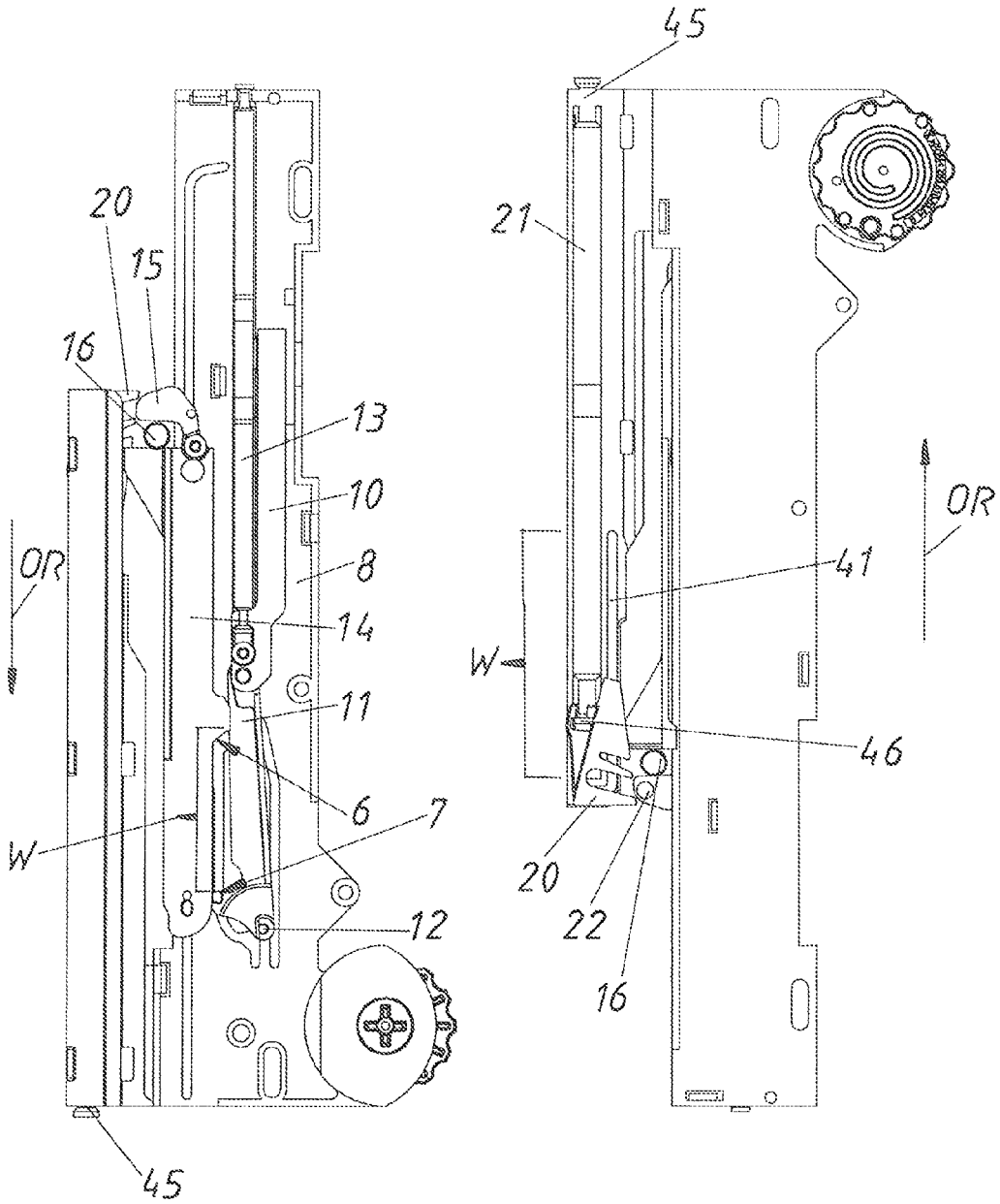
Figures 10A, 10B:
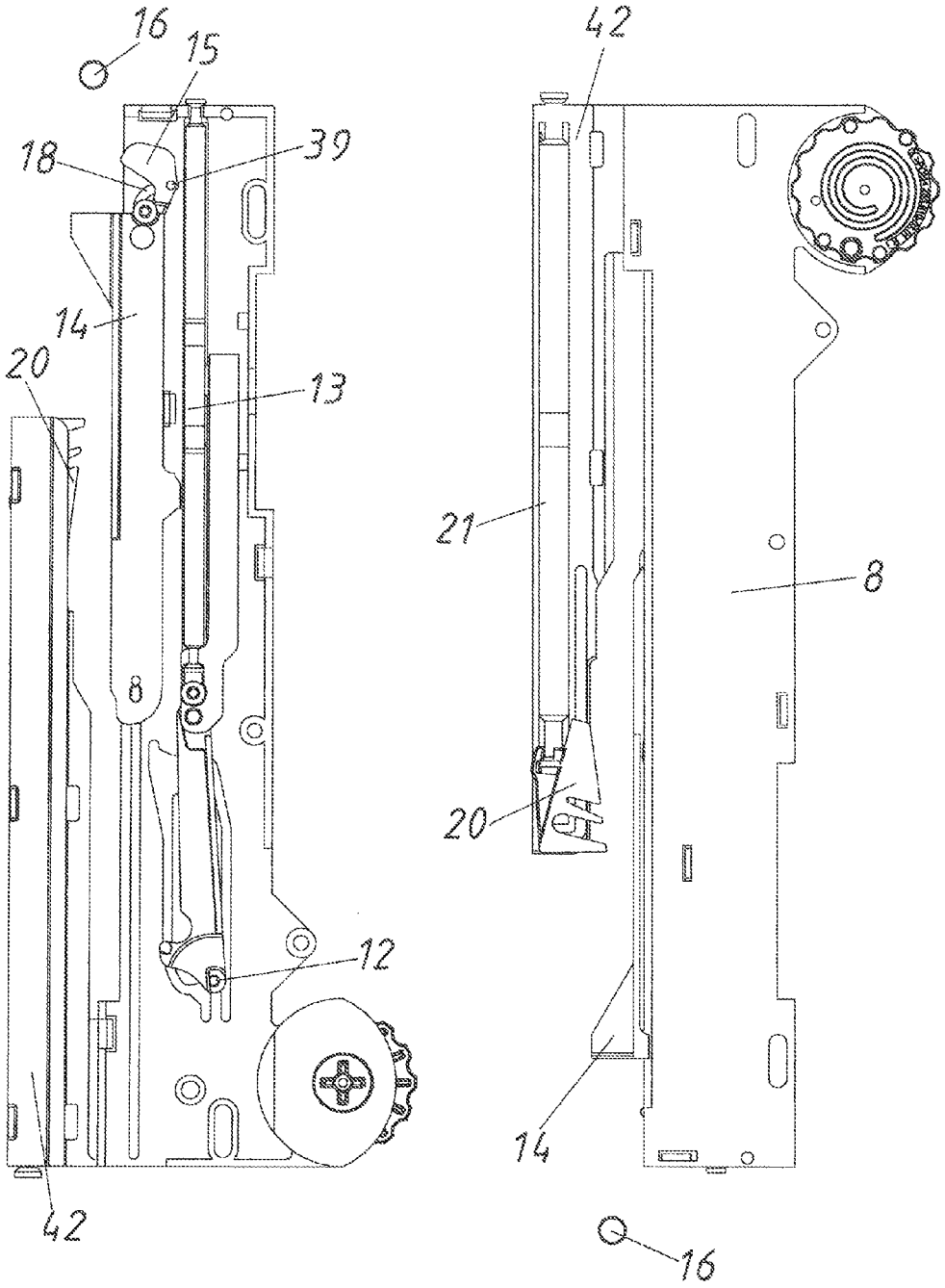

In order, however, to provide a drive device 1 in the form of a structural unit having an ejection device 4 and a retraction device 19, attention is directed to the embodiment shown in FIGS. 8 through 10. FIGS. 8 through 10, in contrast to FIGS. 4 through 7, describe and illustrate opening by pulling, wherein naturally such opening by pulling also correspondingly applies for FIGS. 4 through 7. Conversely, unlocking by over-pressing as shown in FIGS. 4 through 7 correspondingly also applies for FIGS. 8 through 10.

In FIGS. 8(*a*) and 8(*b*), the movable furniture part 3—like also in FIG. 4—is in the closed position SS. In that case, the ejection device 4 is in the locked position V in which the locking pin 12 is locked in the latching region 33 of the guide path 9. As can be seen from FIG. 8(*b*), the rear view of the drive device 1 is shown, with the base plate 8 being connected to a base plate member 42 of the retraction device 19. As essential components, the retraction device 19 has the base plate member 42, the retraction catch element 20, the retraction guide path 41 in the base plate member 42 for the retraction guide element 20 and the retraction force storage means 21 which is fixed on the one hand to the base plate member 42 and on the other hand to the retraction catch element 20. The retraction force storage means 21 is in the form of a tension spring. As a further important component for the retraction device 19, disposed on the catch element 15 of the coupling device 5 is the retraction entrainment portion 22 which is held in the catch region of the retraction catch element 20. The coupling entrainment portion 16, which is separate from the retraction entrainment portion 22, is held between the catch element 15 and the coupling slider 14. If—as shown in FIG. 5—a pressing force is applied to the movable furniture part 3 in the closing direction SR, the elastic arm 44 of the retraction catch element 20 yields and allows movement of the catch element 15 together with the retraction entrainment portion 22 relative to the retraction catch element 20 in opposite relationship to the closing direction SR as the retraction catch element 20 is already in an end abutment condition in the retraction guide path 41. The end abutment condition is necessary to also stop the movable furniture part 3 in the closed position upon being retracted by the retraction device 19, and to not move it further into an over-pressing position US. Nonetheless, movement into the over-pressing position US is to be possible, the elastic arm 44 being provided precisely for that purpose.

If now the movable furniture part 3 is not unlocked and ejected by over-pressing, as shown in FIG. 5, but opening is effected by pulling on the movable furniture part 3, the drive device 1 moves into an open position OS as shown in FIGS. 9(*a*) and 9(*b*). It will be seen, in that position, that the ejection device 4 is still in a locking position V. Upon opening by pulling, the base plate 8 is moved in the opening direction OR relative to the coupling entrainment portion 16 which is fixed with respect to the carcass. As the coupling device 5 is coupled to the coupling entrainment portion 16 by way of the catch element 15 and the coupling entrainment portion 14 and is thus in a coupling position K, the triggering abutment 7 is lifted away from the transmission abutment 6, whereby upon opening by pulling, the coupling device 5 moves loosely with respect to the ejection device 4. The retraction force storage means 21 is also stressed with that opening movement along the first opening travel portion W, as on the one hand the spring base 45 moves by way of the base plate member 42 with the base plate 8 in the opening direction OR, but on the other hand the retraction force storage means 21 is coupled by way of the spring base 46 and the retraction catch element 20 to the retraction entrainment portion 22 provided on the catch element 15. As soon as the angled end portion 47 of the retraction guide path 41 is reached, the retraction catch element 20 pivots so that the retraction catch element 20 is uncoupled from the retraction entrainment portion 22, as shown in FIGS. 9(*a*) and (9*b*). At the same time, however, the coupling device 5 is still in the coupling position K with the coupling entrainment portion 16. In that position, as shown in FIGS. 9(*a*) and 9(*b*), the retraction force storage means 21 is stressed again.

With a further movement of the movable furniture part 3 in the opening direction OR, the drive device 1 passes into the position shown in FIGS. 10(*a*) and 10(*b*), in which the coupling slider 14 and, in particular, the catch element 15 have also reached the angled end portion 18, in which the coupling position K is cancelled, whereby the coupling entrainment portion 16 is no longer held. The ejection device 4 is still in the locked position V.

The present invention thus provides a drive device 1 in which the coupling device 5 is freely movable upon opening by pulling in relation to the ejection device 4. In that way, the ejection device 4 can remain in the locked position V upon opening by pulling. At the same time, however, upon closing, the appropriate coupling position K of the drive device 1 is immediately restored.

The invention claimed is:

1. A drive device for a movable furniture part movable in a furniture carcass, comprising:

an ejection device lockable in a locked position for moving the movable furniture part from a closed position into an open position, wherein the ejection device is unlockable by over-pressing the movable furniture part into an over-pressing position which is behind the closed position in a closing direction, whereby the movable furniture part is movable by the ejection device in an opening direction, wherein the movable furniture part is also movable from the closed position into the open position by pulling on the movable furniture part, wherein the ejection device remains in the locked position upon opening by pulling, a base plate, and a coupling device for coupling the drive device to the movable furniture part or to the furniture carcass, wherein the coupling device is in a coupling position upon ejection of the movable furniture part by the ejection device, wherein the coupling device is movable loosely with respect to the ejection device upon opening by pulling, and wherein the ejection device has a guide path in the base plate, an ejection slider which is movable along the base plate, a locking lever coupled pivotably to the ejection slider, a locking pin mounted to the locking lever and displaceable in the guide path and an ejection force storage member fixed to the base plate and to the ejection slider.

2. The drive device as set forth in claim 1, further comprising a retraction device for retraction of the movable furniture part from the open position into the closed position.

3. The drive device as set forth in claim 2, wherein the retraction device can be brought into engagement by way of a retraction catch element with a retraction entrainment portion which is configured to be separate from a coupling entrainment portion.

4. The drive device as set forth in claim 3, wherein the retraction device can be at least portion-wise coupled to the coupling device by way of the retraction catch element and can be stressed upon opening by pulling a retraction force storage member of the retraction device along first opening travel portion.

5. The drive device as set forth in claim 4, wherein the retraction force storage member is a tension spring.

6. The drive device as set forth in claim 1, wherein, upon opening by pulling, the coupling device remains in the coupling position in a first opening travel portion which is in front of the closed position in the opening direction.

7. The drive device as set forth in claim 6, wherein the first opening travel portion is between 6 mm and 100 mm in length.

8. The drive device as set forth in claim 7, wherein the first opening travel portion is between 20 mm and 70 mm in length.

9. The drive device as set forth in claim 1, wherein the coupling device has a coupling slider displaceable at least portion-wise linearly in the base plate and a catch element mounted moveably on the coupling slider, for engagement with a coupling entrainment portion configured to be arranged on the furniture carcass or on the movable furniture part.

10. The drive device as set forth in claim 9, wherein a transmission abutment of the coupling device is provided on the coupling slider.

11. The drive device as set forth in claim 9, wherein the coupling slider and the catch element are displaceable along a portion-wise linear guide path in the base plate, having an angled end portion.

12. The drive device as set forth in claim 9, wherein the catch element is mounted pivotably on the coupling slider.

13. The drive device as set forth in claim wherein the coupling device has a transmission abutment, by way of which the coupling device bears against a triggering abutment of the ejection device in the closed position and in an over-pressing region between the closed position and the over-pressing position.

14. The drive device as set forth in claim 13, wherein the triggering abutment of the ejection device is provided on the locking lever.

15. An article of furniture having a furniture carcass, a furniture part movable relative to the furniture carcass and a drive device as set forth in claim 1 for the movable furniture part.

16. The article of furniture as set forth in claim 15, wherein the drive device is arranged on the movable furniture part, wherein the coupling device has a coupling entrainment portion which is associated with the furniture carcass and which can be brought into engagement with a catch element.

17. The drive device as set forth in claim 1, wherein the ejection slider is movable linearly along the base plate.

18. The drive device as set forth in claim 1, wherein the ejection force storage member is a tension spring.

19. A drive device for a movable furniture part movable in a furniture carcass, comprising:

an ejection device lockable in a locked position for moving the movable furniture part from a closed position into an open position, wherein the ejection device is unlockable by over-pressing the movable furniture part into an over-pressing position which is behind the closed position in a closing direction, whereby the movable furniture part is movable by the ejection device in an opening direction, wherein the movable furniture part is also movable from the closed position into the open position by pulling on the movable furniture part, wherein the ejection device remains in the locked position upon opening by pulling, a base plate, and a coupling device for coupling the drive device to the movable furniture part or to the furniture carcass, wherein the coupling device is in a coupling position upon ejection of the movable furniture part by the ejection device, wherein the coupling device is movable loosely with respect to the ejection device upon opening by pulling, wherein the ejection device has a cardioid-shaped guide path in the base plate, an ejection slider which is movable along the base plate, a locking lever coupled pivotably to the ejection slider, and a locking pin mounted to the locking lever and displaceable in the cardioid-shaped guide path, and wherein the ejection slider can be locked by the locking pin in the cardioid-shaped guide path with a latching region.

20. The drive device as set forth in claim 19, wherein the ejection device has an ejection force storage member fixed to the base plate and the ejection slider.

* * * * *